US006213855B1

(12) United States Patent
Natalicio

(10) Patent No.: US 6,213,855 B1
(45) Date of Patent: Apr. 10, 2001

(54) SELF-POWERED CARRIER FOR POLISHING OR PLANARIZING WAFERS

(75) Inventor: John Natalicio, Los Angeles, CA (US)

(73) Assignee: SpeedFam-IPEC Corporation, Chandler, AZ (US)

( * ) Notice: Subject to any disclaimer, the term of this patent is extended or adjusted under 35 U.S.C. 154(b) by 0 days.

(21) Appl. No.: 09/360,536

(22) Filed: Jul. 26, 1999

(51) Int. Cl.[7] ..... B24B 41/06
(52) U.S. Cl. ..... 451/364; 451/288
(58) Field of Search ..... 451/364, 397, 451/398, 285, 286, 287, 288, 289, 290

(56) References Cited

U.S. PATENT DOCUMENTS

| | | | | |
|---|---|---|---|---|
| 4,805,348 | | 2/1989 | Arai et al. . | |
| 4,811,522 | | 3/1989 | Gill, Jr. . | |
| 5,099,614 | | 3/1992 | Arai et al. . | |
| 5,329,732 | | 7/1994 | Karlsrud et al. . | |
| 5,476,414 | | 12/1995 | Hirose et al. . | |
| 5,498,196 | | 3/1996 | Karlsrud et al. . | |
| 5,498,199 | | 3/1996 | Karlsrud et al. . | |
| 5,558,568 | | 9/1996 | Talieh et al. . | |
| 5,916,015 | * | 6/1999 | Natalicio | 451/288 |
| 5,989,103 | * | 11/1999 | Birang et al. | 451/41 |
| 5,989,104 | * | 11/1999 | Kim et al. | 451/41 |

* cited by examiner

*Primary Examiner*—David A. Scherbel
*Assistant Examiner*—Dung Van Nguyen
(74) *Attorney, Agent, or Firm*—Snell & Wilmer, L.L.P.

(57) ABSTRACT

A wafer carrier for polishing or planarizing semiconductor workpieces or wafers includes a pressure plate, an upper housing, and a lower housing. The pressure plate is configured to hold a wafer to be polished or planarized against a polishing pad, and further configured to rotate about the lower housing of the wafer carrier to rotate the wafer during the polishing or planarizing process. The wafer carrier includes an electric direct drive motor, with the stators of the motor disposed in the lower housing and the rotors of the motor disposed in the pressure plate, to rotate the pressure plate about the lower housing. Accordingly, when electric power is supplied to the stators of the direct drive motor, in response to the magnetic flux generated by the stators, the rotors of the motor rotate the pressure plate. The wafer carrier also includes a compliant material disposed between the upper housing and the lower housing of the wafer carrier to form a flexible joint which maintains the wafer in substantially parallel and in substantially full contact with the polishing pad. Additionally, the lower housing of the wafer carrier is pressurized to cause pressure to be applied across substantially all of the surface area of the pressure plate and substantially uniformly across the surface area of the wafer.

11 Claims, 2 Drawing Sheets

SELF-POWERED CARRIER FOR POLISHING OR PLANARIZING WAFERS

BACKGROUND OF THE INVENTION

1. Field of the Invention

The present invention relates generally to an apparatus for polishing or planarizing semiconductor workpieces such as silicon wafers. More particularly, the present invention relates to a wafer carrier for planarizing or polishing wafers on a polishing pad.

2. Description of the Related Art

Silicon workpieces or wafers, which are typically flat and circular in shape, are used in manufacturing semiconductor devices. Wafers are initially sliced from a silicon ingot and, thereafter, undergo multiple masking, etching, and dielectric and conductor deposition processes to create microelectronic structures and circuitry. The surface of a wafer undergoing these processes typically are polished or planarized between processing steps to ensure proper flatness to facilitate the use of photo lithographic processes for building additional dielectric and metallization layers on the wafer surface.

Chemical Mechanical Planarization ("CMP") machines have been developed to polish or planarize silicon wafer surfaces to the flat condition desired for manufacture of integrated circuit components and the like. For examples of conventional CMP processes and machines, see U.S. Pat. No. 4,805,348, issued in February 1989 to Arai, et al.; U.S. Pat. No. 4,811,522, issued in March 1989 to Gill; U.S. Pat. No. 5,099,614, issued in March 1992 to Arai et al.; U.S. Pat. No. 5,329,732, issued in July 1994 to Karlsrud et al.; U.S. Pat. No. 5,476,414, issued in December 1995 to Masayoshi et al.; U.S. Pat. Nos. 5,498,196 and 5,498,199, both issued in March 1996 to Karlsrud et al.; and U.S. Pat. No. 5,558,568, issued in September 1996 to Talieh et al.

Typically, a CMP machine includes a wafer carrier configured to hold and to rotate a wafer during the polishing or the planarizing of the wafer. For example, with reference to FIG. 1, a conventional wafer carrier 100 includes an upper housing 101 and a pressure plate 104 mounted underneath a lower or secondary housing 106. A plurality of fasteners 108 fix pressure plate 104 to lower housing 106. A plurality of vacuum holes 110 hold the wafer to be planarized to the planar lower surface of pressure plate 104. Wafer carrier 100 then presses the wafer against a polishing pad (not shown) to polish or to planarize the wafer. More particularly, pressure plate 104 applies pressure to the wafer such that the wafer engages the polishing pad with a desired amount of pressure. The pressure plate and the polishing pad are also rotated, typically with differential velocities, to cause relative lateral motion between the polishing pad and the wafer to produce a more uniform thickness. Additionally, an abrasive slurry, such as a colloidal silica slurry, is often provided to enhance the polishing or planarizing process.

Conventional wafer carriers are typically rotated by a drive motor through a central drive shaft and a mechanical bearing assembly. For example, conventional wafer carrier 100 includes a bearing assembly 112 disposed between lower housing 106 and upper housing 101 and a drive shaft 114 connected to a drive motor (not shown). Bearing assembly 112 permits the movement of lower housing 106 and pressure plate 104 relative to upper housing 101 in order to maintain the surface of the wafer in parallel contact with the polishing pad even when the pad deviates from planarity. This motion is often referred to as "gimballing", and the "gimbal point" is defined as the intersection of the plane in which the pressure plate 104 gimbals and the vertical central axis of the carrier. The gimbal point of wafer carrier 100, for example, is at point 116. The location of the gimbal point above the lower or backing surface of the pressure plate, however, can result in excessive tipping of the wafer with respect to the polishing pad, thus causing uneven edge polishing and detracting from uniform pressure distributed across the wafer.

Another shortcoming of conventional wafer carriers which arc rotated by a central drive shaft is the lag in response time due to the inertia of the wafer carrier. For example, when a torque is initially applied to drive shaft 114 to begin to rotate wafer carrier 100, the mass of wafer carrier 100 results in a lag in response time of the wafer carrier 100. Accordingly, the outer diameter portions of the wafer carrier 100 may initially rotate slower than the inner diameter portions of the wafer carrier 100, thus contributing to uneven polishing or planarizing of the wafer. Additionally, the mass of wafer carrier 100 may result in undesired vibrations when the rotational speed of drive shaft 114 is increased or decreased, thus further contributing to uneven polishing or planarizing of the wafer.

An additional shortcoming of conventional wafer carriers is that the downward pressure applied to the drive shaft is not ideally distributed across the wafer. For example, in carrier 100, upper housing 101 is connected to outer ring 118 of bearing assembly 112 by fasteners 120, while inner ring 122 of bearing assembly 112 is connected to lower housing 106 by fasteners 124. Hence, the pressure distribution path is as follows: downward pressure applied from the drive shaft is transmitted into upper housing 101, transmitted through fasteners 120 and into outer bearing ring 118, transmitted through bearing assembly 112 to inner bearing ring 122, and transmitted through fasteners 124 to the narrow central body portion 126 of lower housing 106 and pressure plate 104. Consequently, the downward pressure is concentrated at the central portion of the wafer and effects excessive material removal in the inner diameter portions of the wafer, while bowing and inadequate removal occurs at the outside diameter portions of the wafer.

SUMMARY OF THE INVENTION

In accordance with an exemplary embodiment of the present invention, a wafer carrier for polishing or planarizing semiconductor workpieces or wafers includes a pressure plate, an upper housing, and a lower housing. In accordance with one aspect of the present invention, the pressure plate is configured to hold a wafer to be polished or to be planarized against a polishing pad, and further configured to rotate about the lower housing to rotate the wafer during the polishing or the planarizing process. In accordance with another aspect of the present invention, the wafer carrier includes an electric direct drive motor, with the stators of the motor disposed in the lower housing and the rotors of the motor disposed in the pressure plate, to rotate the pressure plate about the lower housing. Accordingly, when electric power is supplied to the stators of the electric direct drive motor, the rotors of the motor rotate the pressure plate in response to the electromagnetic flux generated by the stators. The torque generated by the motor is developed in close proximity to the wafer, thus lowering the gimballing point of the carrier and thereby reducing the amount of gimballing or tilting force imparted to the wafer. The wafer thus tends to remain essentially parallel with the polishing pad surface.

In accordance with still another aspect of the present invention, a compliant material is disposed between the upper housing and the lower housing of the wafer carrier to form a flexible joint, or bellows, which maintains the wafer in substantially parallel and in substantially full contact with the polishing pad. In accordance with yet another aspect of the present invention, the lower housing of the wafer carrier is pressurized to apply pressure across substantially all of the surface area of the pressure plate and substantially uniformly across the surface area of the wafer.

BRIEF DESCRIPTION OF THE DRAWING

The subject matter of the invention is particularly pointed out and distinctly claimed in the concluding portion of the specification. The invention, however, both as to organization and method of operation, may best be understood by reference to the following description taken in conjunction with the claims and the accompanying drawing, in which like parts may be referred to by like numerals:

DETAILED DESCRIPTION

The subject matter of the present invention is particularly suited for use in connection with Chemical Mechanical Planarization ("CMP") of semiconductor workpieces or wafers. As a result, an exemplary embodiment of the present invention is described in that context. It should be recognized, however, that such description is not intended as a limitation on the use or applicability of the present invention, but is instead provided to enable a complete description of an exemplary embodiment.

In the relevant art, the terms "polishing" and "planarizing" are used to describe a wide range of both wet and dry processing of semiconductor workpieces or wafers to produce a substantially flat or planar surface thereon. Although the present invention is described in connection with CMP processing of wafers, it should be appreciated that the present invention can be employed with any convenient wafer polishing or planarizing technique, such as chemical-mechanical polishing, lapping, grinding, honing, slurry polishing, and the like. For a more detailed discussion of the CMP process, see U.S. patent application Ser. No. 08/926,700, filed Sep. 10, 1997, the entire content of which is incorporated herein by reference.

Figure 1:
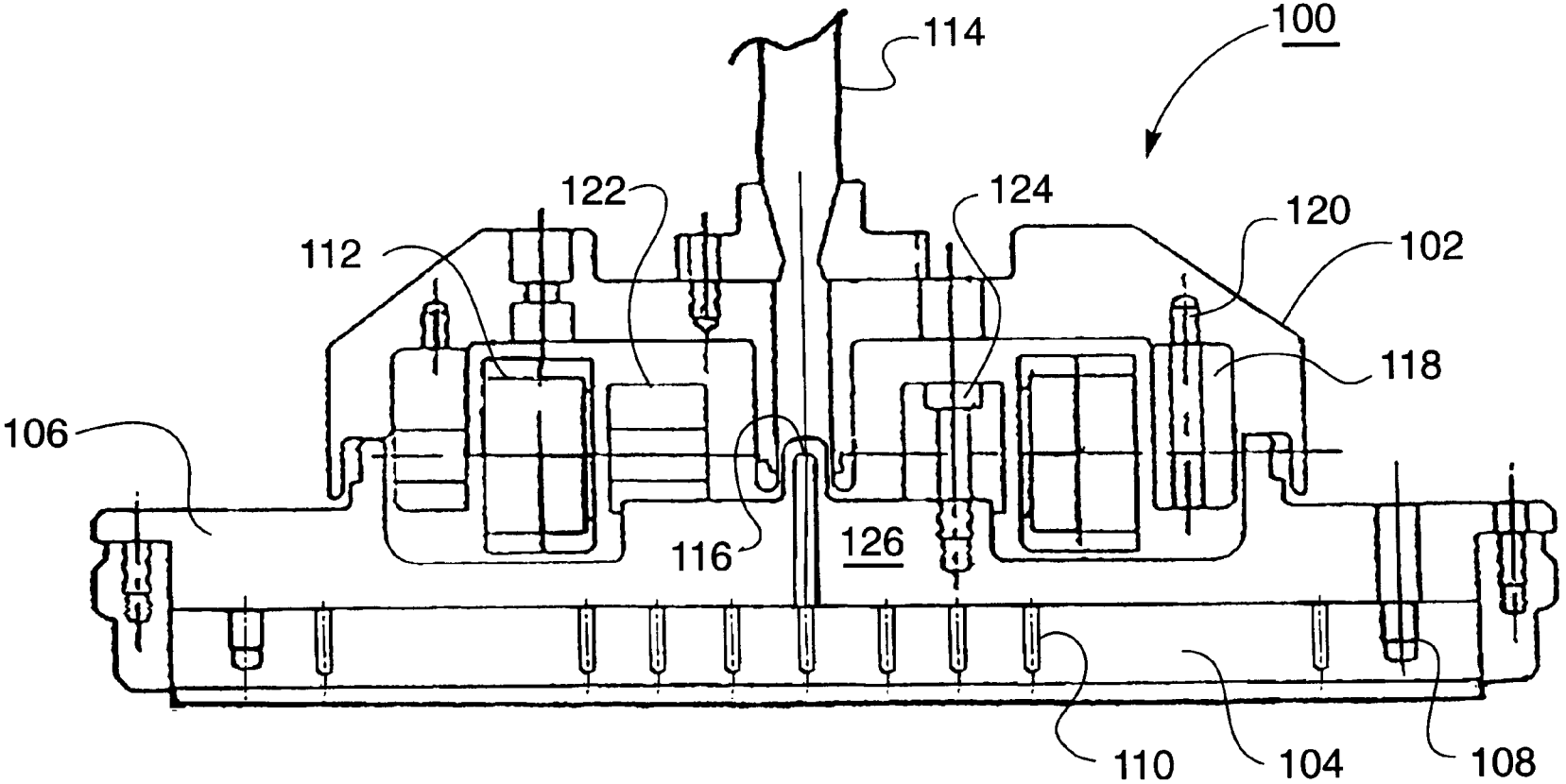
FIG. 1. (PRIOR ART)
FIG. 1 is a cross sectional view of a prior art wafer carrier.
Figure 2:
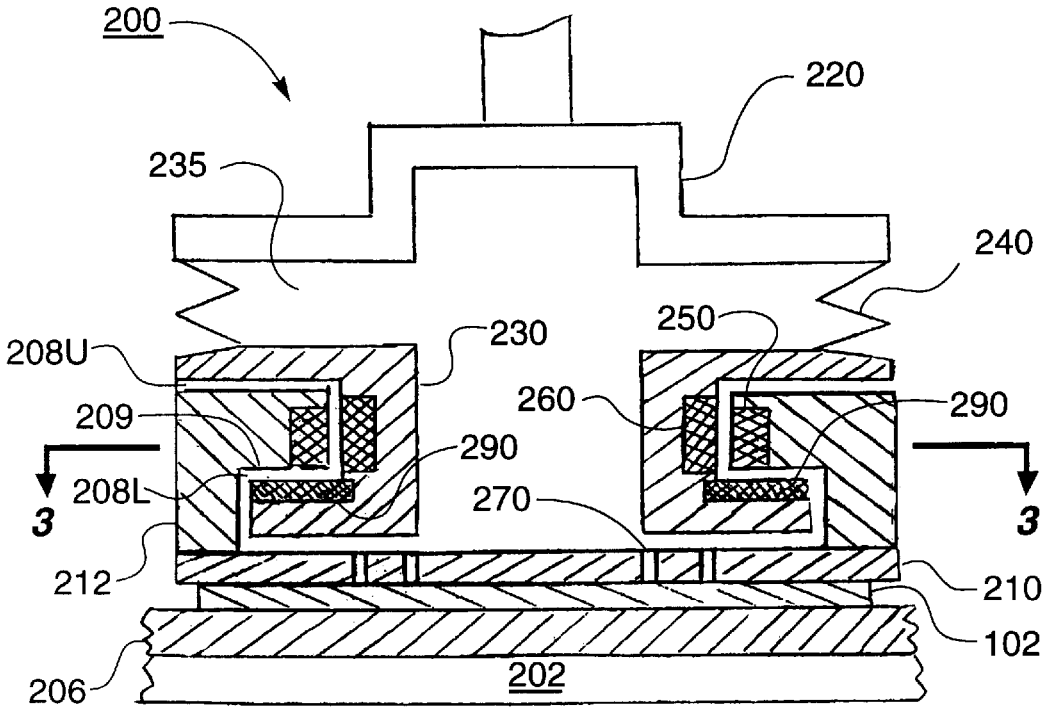
FIG. 2 is a cross sectional view of a wafer carrier in accordance with various aspects of the present invention.

FIG. 2 is a cross sectional view of a wafer carrier in accordance with various aspects of the present invention. As depicted in FIG. 2, a carrier head 200 according to various aspects of the present invention is suitably employed to polish or to planarize a wafer 102 by applying pressure on wafer 102 to engage the underside of wafer 102 against a polishing pad 206. Polishing pad 206 (FIG. 2) is preferably attached to polishing table 202, and is preferably formed from polyurethane, such as the IC and GS series of polishing pads available from Rodel Products Corporation of Scottsdale, Ariz. However, it should be appreciated that polishing pad can be formed from any suitable polishing material depending on the particular application. For example, polishing pad 206 can include a grinding stone, a diamond pellet, a lapping plate, and the like.

With reference to FIG. 2, in an exemplary embodiment of the present invention, carrier head 200 includes a pressure plate 210, an upper housing 220, and a lower housing 230. During the polishing process, wafer 102 is held by pressure plate 210. More particularly, a plurality of vacuum ports 270 formed in pressure plate 210 secure wafer 102 to pressure plate 210. Methods of providing a vaccum to ports 270 are well known in the art. It should be appreciated, however, that wafer 102 can be secured to pressure plate 210 using various methods, such as, for example, wet surface tension.

In the present exemplary embodiment, pressure plate 210 is substantially circular and appropriately sized to apply pressure across substantially the entire upper surface of wafer 102. Accordingly, the specific shape and size of pressure plate 210 can vary depending on the shape and size of wafer 102. According to various aspects of the present invention, pressure plate 210 may be formed using any convenient method, such as casting, milling, and the like. Additionally, pressure plate 210 can be formed from any suitably rigid material, such as metal, ceramic, and the like. Furthermore, pressure plate 210 can be coated with protective material such as urethane to protect the upper surface of wafer 102.

As indicated above, during the polishing or planarizing process, pressure plate 210 rotates wafer 102 to more uniformly remove material therefrom and to accelerate the polishing or planarizing process. In the present exemplary embodiment of the invention, pressure plate 210 is preferably configured to rotate around lower housing 230. More particularly, in the present exemplary embodiment, pressure plate 210 includes an arm 212 and a groove 208, which is preferably formed in lower housing 230 to receive arm 212. Although in FIG. 2 arm 212 and pressure plate 210 are depicted as separate pieces, it should be appreciated, however, that arm 212 and pressure plate 210 can be formed as a single piece using any convenient method. For example, arm 212 and pressure plate 210 can be cast together as a single piece. Additionally, although in FIG. 2 groove 208 is depicted as having a substantially square shaped profile, it should be appreciated that groove 208 and arm 212 can be configured with profiles having various shapes depending on the particular application. For example, groove 208 can be configured with a substantially concave shaped profile and arm 212 can be configured with a substantially matching convex shaped profile. Alternatively, groove 208 can be configured with a substantially convex shaped profile and arm 212 can be configured with a substantially matching concave shaped profile.

A bearing ring 290 according to various aspects of the present invention is preferably disposed within groove 208 (shown as having an upper portion 208U and a lower portion 208L) to facilitate the movement of arm 212 within groove 208. Although groove 208 is shown in FIG. 2 as a continuous void for the purpose of clarity, in practice, surface 209 of arm 212 rests slidably on bearing ring 290. In the present exemplary embodiment, bearing ring 290 is preferably configured as an o-ring formed from any suitable low friction material with a low coefficient of friction, such as polytetrafluoroethylene, (commercially known as TEFLON®). Alternatively, a mechanical system, such as ball-bearings, bushings, and the like, can be employed to facilitate the movement of arm 212 within groove 208. Although bearing ring 290 is depicted in FIG. 2 as being a ring disposed between the lower surface of arm 212 and groove portion 208L, it should be appreciated that bearing ring 290 can be configured with various shapes and dimensions depending on the particular application. For example, bearing ring 290 can be configured with a profile substantially similar to the profile of groove 208. Alternatively, an additional bearing ring 290 can be disposed between the upper portion of arm 212 and groove portion 208U.

Figure 3:
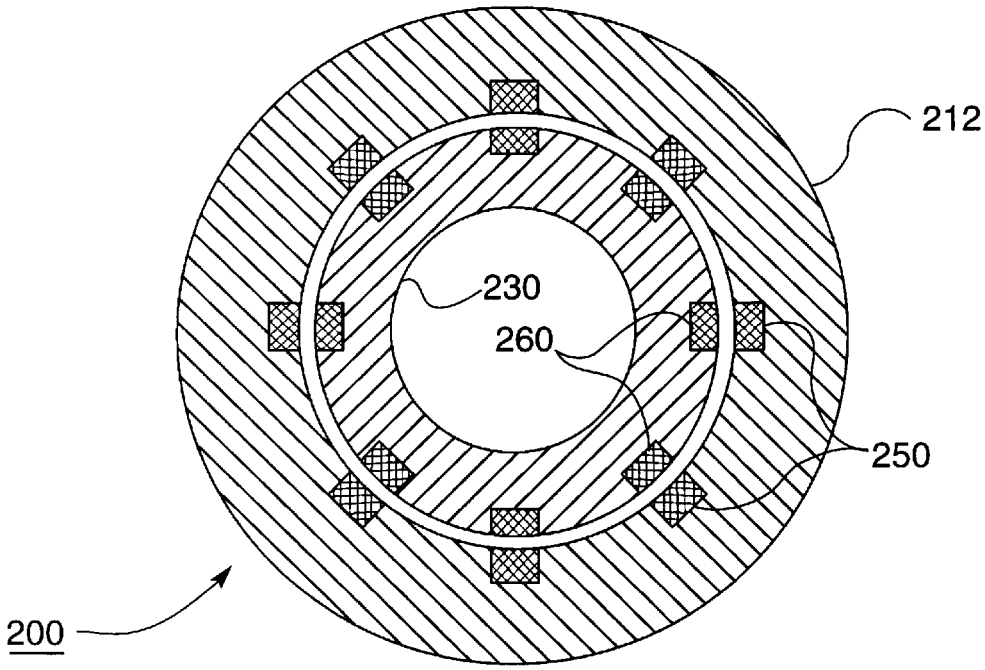
FIG. 3 is a top plan view of the wafer carrier shown in FIG. 2 taken through lines 5—5.

FIG. 3 is a top plan view of the wafer carrier shown in FIG. 2 taken through lines 5—5. In accordance with various aspects of the present invention, an electric direct drive motor comprising a plurality of rotors 250 and stators 260 is employed to rotate pressure plate 210 about lower housing 230 of wafer carrier 200. With reference to FIG. 3, in the present exemplary embodiment of the present invention, a plurality of rotors 250 are disposed about the circumference of arm 212, and a plurality of stators 260 are disposed about the circumference of lower housing 230. The configuration of rotors 250 and stators 260 about the circumference of arm 212 and the circumference of lower housing 230, respectively, is particularly advantageous in that a torque can be applied directly to the outer circumference of pressure plate 210 (FIG. 2), thus reducing the lag time which can result if a torque is applied to the center of wafer carrier 200 as in conventional systems. Additionally, less torque is required to rotate pressure plate 210 in comparison to conventional system in which the entire wafer carrier 200 is rotated. Accordingly, the present invention facilitates faster acceleration and response time in rotating pressure plate 210 which in turn facilitates a more uniform polishing or planarizing of wafer 102.

With reference to FIG. 2, in the present exemplary embodiment, plurality of rotors 250 include permanent magnets ranging in diameter from about 8 to 12 inches in diameter and about ¾ inch wide. It should be recognized, however, that the plurality of rotors 250 can include magnets with various dimensions and shape depending on the particular application. For example, increasing the size of the magnets used as plurality of rotors 250 can increase the overall torque applied to pressure plate 210. This exemplary configuration of using permanent magnets as plurality of rotors 250 has the advantage in that no electrical wires need to be provided to the rotating portion of the pressure plate 210 to magnetize the plurality of rotors 250. It should be appreciated, however, that plurality of rotors 250 can be configured as electromagnets. In such a configuration, a rotary slip-joint or the like may be used for applying current to the electromagnets.

In the present exemplary embodiment, plurality of stators 260 include a plurality of electric coils suitably configured to produce a magnetic flux sufficient to rotate pressure plate 210 at a rotational speed of at least 50 rpm. The direct drive motor comprising rotors 250 and stators 260 preferably generates a minimum of 0.2 horsepower with 95 ft-lbs of torque at 10 rpm, and 0.85 horsepower with 89 ft-lbs of torque at 50 rpm. It should be recognized, however, that the plurality of stators 260 can include electric coils configured to produce various amounts of magnetic flux depending on the particular application. For example, increasing the amount of magnetic flux produced by stators 260 can increase the overall torque applied to pressure plate 210.

With reference to FIG. 3, when electric power is provided to plurality of stators 260 sequentially in the desired rotational direction, the magnetic flux generated by plurality of stators 260 exerts a force on the plurality of rotors 250 to rotate pressure plate 210 (FIG. 2) in the same direction. For example, when electric power is provided to stators 260 sequentially in a clockwise direction, pressure plate 210 also rotates in a clockwise direction. Similarly, when electric power is provided to stators 260 sequentially in a counter-clockwise direction, pressure plate 210 also rotates in a counter-clockwise direction. Additionally, the direction in which power is provided to stators 260 may be alternated, thus oscillating pressure plate 210.

Although eight rotors 250 and eight stators 260 are depicted in FIG. 3, it should be appreciated that any number of rotors 250 and stators 260 can be employed depending on the particular application. For example, the torque applied to pressure plate 210 can be increased or decreased by employing more or fewer rotors 250 and stators 260. This aspect of the present invention is particularly advantageous in that the torque applied to pressure plate 210 can be increased without necessarily increasing the size of the existing rotors 250 and stators 260 which would increase the vertical profile of wafer carrier 200.

Additionally, although rotors 250 and stators 260 are depicted in FIG. 3 as being disposed in equally spaced increments, it should be appreciated that rotors 250 and stators 260 can be disposed in various patterns depending on the particular application. Disposing rotors 250 and stator 260 in equally spaced increments, however, has the advantage of equally distributing the torque applied to the pressure plate 210, thus facilitating a more uniform polishing and planarizing of wafer 102.

Furthermore, it should be appreciated that pressure plate 210 can be rotated using any convenient electric motor depending on the particular application without deviating from the spirit or scope of the present invention. The direct drive motor assembly described above, however, has the particular advantage of providing fast response time and high rate of acceleration, which is essentially limited by the adhesion/retention between the wafer 102 and carrier 200.

With reference to FIG. 2, in accordance with another aspect of the present invention, carrier head 200 preferably includes a compliant member 240 disposed between upper housing 220 and lower housing 230. The flexible joint formed between upper housing 220 and lower portion 230 facilitates a floating joint whereby pressure plate 210 can pivot along its x-, y- and z-axes relative to upper housing 220. Hence, pressure plate 210 is able to mimic movement of the polishing pad 206 in the x-, y- or z-directions to thereby dynamically and continuously adjust the plane of wafer 102 held by wafer carrier 200 relative to polishing pad 206 and maintain wafer 102 in substantially parallel and in substantially full contact with polishing pad 206, thus facilitating a more uniform polishing and planarizing of wafer 102. The use of compliant member 240 to form a flexible joint has the advantage that no lubricants, which can contaminate wafer 102, are needed as in conventional mechanical bearing assemblies. In the present exemplary embodiment of the present invention, compliant member 240 functions as a bellows. Compliant member 240 can be formed from any suitable compliant material, such as rubber, plastic, or metal.

In accordance with another aspect of the present invention, chamber 235 of wafer carrier 200 is pressurized to apply a desired polishing pressure on pressure plate 210. The pressure is applied across substantially all of the surface area of pressure plate 210 and substantially uniformly across the surface area of pressure plate 210. Accordingly, the pressure applied by pressure plate 210 to wafer 102 is applied across substantially all of the surface area of wafer 102 and substantially uniformly across the surface area of wafer 102 to facilitate a more uniform polishing or planarizing of wafer 102. In the exemplary embodiment, chamber 235 is pressurized with approximately 5 to 10 psi of pressure. It should be appreciated, however, that various amounts of pressure can be employed depending on the particular application.

It is to be noted that the wafer carrier 200 of the present invention can be retrofitted to existing CMP machines, and advantageously employed in conjunction with a wide range of polishing or planarizing operations.

Although the present invention is set forth herein in the context of the appended drawing figures, it should be appreciated that the invention is not limited to the specific forms shown. Various other modifications, variations, and enhancements in the design, arrangement, and implementation may be made without departing from the spirit and scope of the present invention set forth herein. Furthermore, one of skill in the art will appreciate that various other applications and uses exist for the wafer carrier 200 besides the specific examples given.

I claim:

1. A wafer carrier for planarizing a workpiece against a polishing pad, said carrier comprising:

a circular lower housing;

a pressure plate for holding the wafer against the polishing pad; and an electric direct drive motor for rotating said pressure plate comprising a plurality of stators disposed in said lower housing and a plurality of rotors disposed in said pressure plate.

2. The wafer carrier of claim 1, wherein said pressure plate is configured to rotate within said lower housing, having an outer circumferential surface formed with a groove, and wherein said pressure plate includes an arm which fits within said groove.

3. A wafer carrier in accordance with claim 2 further comprising a bearing ring disposed within said groove to facilitate rotation of said arm of said pressure plate within said groove formed in said lower housing.

4. A wafer carrier in accordance with claim 3 wherein said bearing ring is formed from a material with a low coefficient of friction.

5. A wafer carrier in accordance with claim 1 wherein each of said plurality of stators includes an electric coil, and each of said plurality of rotors includes a permanent magnet.

6. A wafer carrier in accordance with claim 1 further comprising an upper housing and a compliant bellows disposed between said lower housing and said upper housing to urge the wafer into parallel contact with the polishing pad.

7. A wafer carrier in accordance with claim 1 wherein said lower housing of the wafer carrier contains a chamber which is pressurized with air to cause pressure to be applied uniformly across substantially all of the surface area of the pressure plate.

8. A wafer carrier for planarizing a workpiece against a polishing pad, said carrier comprising:

a circular lower housing:

a pressure plate for holding the wafer against the polishing pad;

an upper housing;

a compliant bellows disposed between said lower housing and said upper housing to urge the wafer into parallel contact with the polishing pad; and an electric direct drive motor for rotating said pressure plate including a plurality of stators disposed in said lower housing and a plurality of rotors disposed in said pressure plate;

wherein said pressure plate is configured to rotate within said lower housing, having an outer circumferential surface formed with a groove, said pressure plate including an arm which fits within said groove.

9. A wafer carrier in accordance with claim 8, further comprising a bearing ring disposed within said groove to facilitate rotation of said arm of said pressure plate within said groove.

10. A wafer carrier in accordance with claim 8, wherein each of said plurality of stators includes an electric coil, and each of said plurality of rotors includes a permanent magnet.

11. A wafer carrier in accordance with claim 8, wherein said lower housing of the wafer carrier is pressurized with air to cause pressure to be applied uniformly across substantially all of the surface area of the pressure plate.

* * * * *